United States Patent [19]

Lawson

[11] 4,296,504

[45] Oct. 27, 1981

[54] TOILET SEAT LOCK

[76] Inventor: Daniel C. Lawson, 6611 W. 174th St., Tinley Park, Ill. 60477

[21] Appl. No.: 166,160

[22] Filed: Jul. 7, 1980

[51] Int. Cl.[3] ..... A47K 13/00

[52] U.S. Cl. ..... 4/253

[58] Field of Search ..... 4/253, 237, 239, 661; 24/230 AP, 241 P

[56] References Cited

U.S. PATENT DOCUMENTS

| | | | |
|---|---|---|---|
| 3,116,527 | 1/1964 | Springer | 4/253 X |
| 3,431,004 | 3/1969 | Schell | 4/253 X |
| 3,477,070 | 11/1969 | Kimben | 4/253 |
| 4,060,861 | 12/1977 | Lawrence | 4/253 |
| 4,145,771 | 3/1979 | Khazm | 4/253 |

*Primary Examiner*—Henry K. Artis

*Attorney, Agent, or Firm*—John Vander Weit, Jr.

[57] ABSTRACT

A device for use with a toilet seat including a lever adapted to fit through a hole in the toilet seat cover so as to allow rotation of the lever when the toilet seat cover is in a horizontal position, a latch connected to the lever so that the latch will rotate in direct relationship to the lever and pivotally connected to the lever so that when the toilet seat cover is in a vertical position, the latch will lay substantially against the toilet seat cover and when the toilet seat cover is in a horizontal position, the latch will hang away from the toilet seat cover, and a retainer which is adapted to be affixed to a toilet and positioned so that when the toilet seat cover is in a horizontal position, rotation of the lever will allow rotation of the latch into or out from the retainer.

10 Claims, 5 Drawing Figures

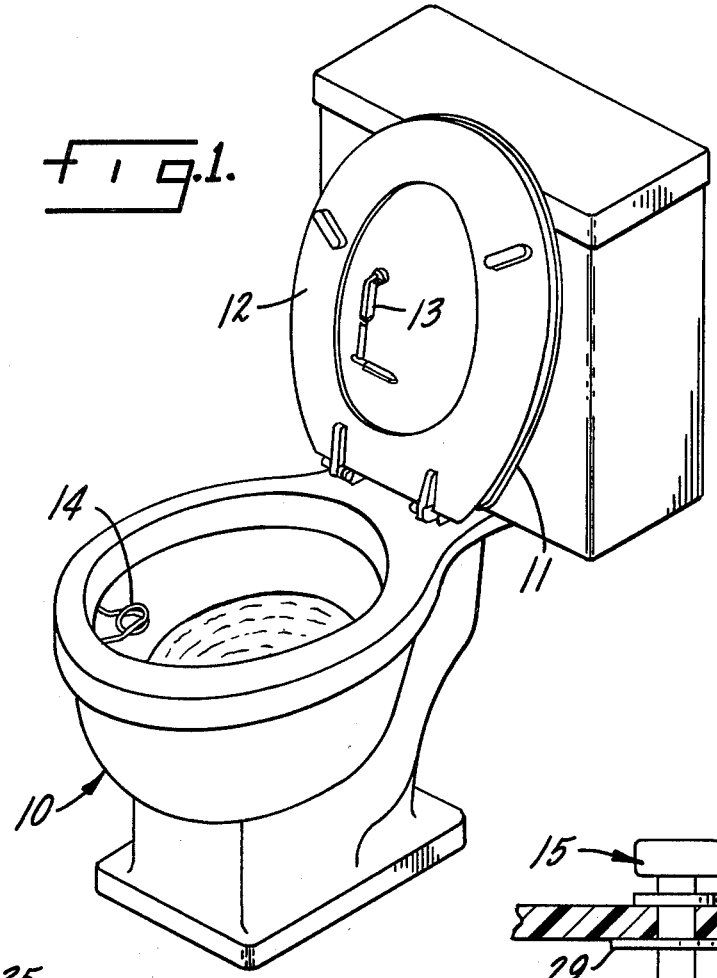
Fig. 1.
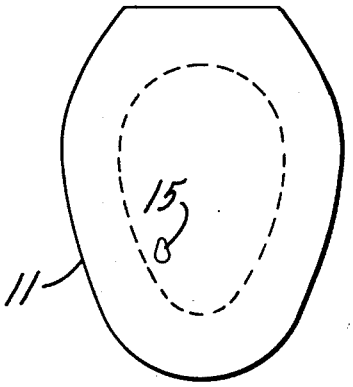
Fig. 1A.
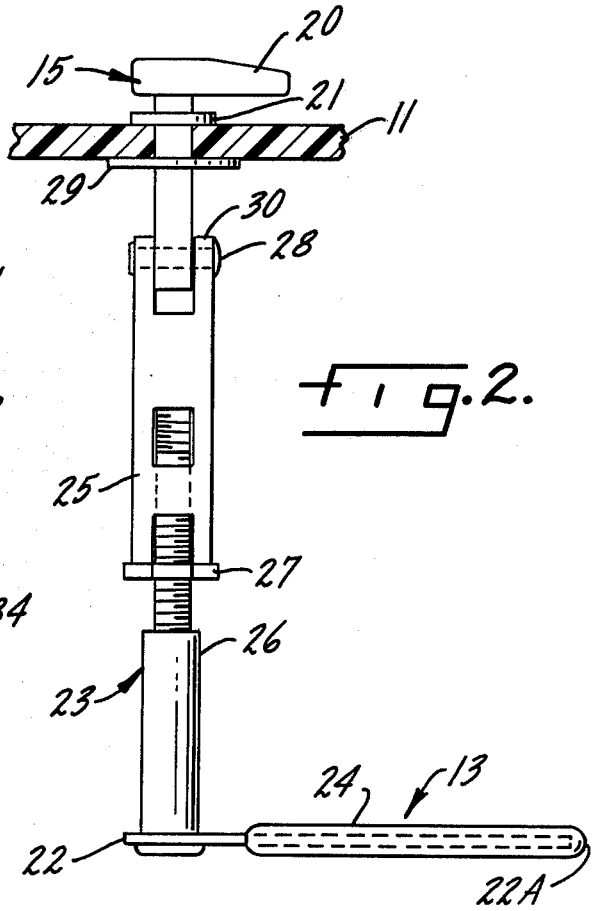
Fig. 2.
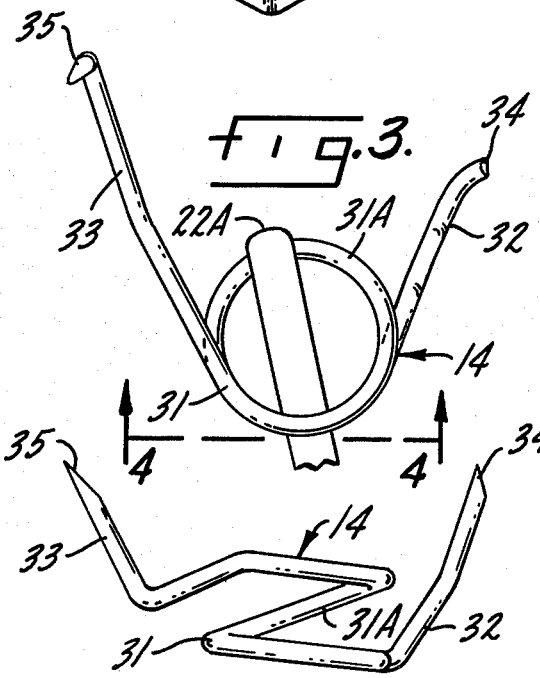
Fig. 3.
Fig. 4.

TOILET SEAT LOCK

BACKGROUND OF THE INVENTION

This invention relates generally to toilet seat covers and more particularly concerns a device which will allow locking of a toilet seat cover in place when desired.

It has long been a problem that small children readily open toilet covers, allowing them to dispose of myriads of items which are not desired to be disposed or will block or damage a toilet. Additionally, many pet owners find that their pets are likewise able to open a toilet seat cover allowing them to drink from the toilet bowl and usually make a mess from the water which drips or splashes during their use. A serious problem can occur if a young child falls or crawls in an open toilet which could cause injury or drowning. These problems are further compounded when bacteria or poisons commonly used to clean the toilet are present.

Accordingly, it is an object of this invention to develop a device which will allow the locking of a toilet seat cover in place which is pet-proof and child-proof until an age when the child understands the use and dangers of a toilet. A further object is to provide a device which is suitable for attachment to a standard toilet commonly used in the United States and other countries and without severe alteration of the toilet or toilet seat cover or necessity of a new toilet.

A SUMMARY OF THE INVENTION

In accordance with the invention, a device is provided for use with a toilet seat including a lever adapted to fit through a hole in the toilet seat cover so as to allow rotation of the lever when the toilet seat cover is in a horizontal position, a latch connected to the lever so that the latch will rotate in direct relationship to the lever and pivotally connected to the lever so that when the toilet seat cover is in a vertical position, the latch will lay substantially against the toilet seat cover and when the toilet seat cover is in a horizontal position, the latch will hang away from the toilet seat cover, and a retainer which is adapted to be affixed to a toilet and positioned so that when the toilet seat cover is in a horizontal position, rotation of the lever will allow rotation of the latch into or out from the retainer.

BRIEF DESCRIPTION OF THE DRAWINGS

Other objects and advantages of the invention will become apparent upon the reading the following detailed description and upon reference to the drawings in which:

FIG. 1 is a schematic view of a toilet and toilet seat cover with a device constructed in accordance with the instant invention attached thereto;

FIG. 1A is a plan partial view of the toilet seat cover of FIG. 1;

FIG. 2 shows a lever and a latch constructed in accordance with the instant invention;

FIG. 3 shows a top view of a retainer constructed in accordance with the instant invention; and, FIG. 4 is a elevation of the retainer of FIG. 3 taken along sight line 4—4.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Turning first to FIG. 1, a toilet 10 is shown including a toilet seat cover 11 and a toilet seat 12. A latch 13 and a retainer 14 constructed in accordance with the instant invention are also shown. In FIG. 1A, the top of toilet seat cover 11 is shown with a lever 15 constructed in accordance with the instant invention. When toilet seat cover 11 is closed or in horizontal position, one may adjust lever 15 so that latch 13 attaches to retainer 14 and toilet seat cover 11 may not be raised until lever 15 is turned to unattach latch 13 from retainer 14.

Turning to FIG. 2, latch 13 and lever 15 are shown in more detail. Lever 15 includes lever arm 20 which allows for easy rotation of lever 15 and also an indication of whether or not latch 13 is in a locked or unlocked mode. Lever 15 also includes a lip 21 which supports lever 15 from falling through toilet seat cover 11 and supports the weight of latch 13.

Latch 13 contains a locking portion 22 and a hanging portion 23. Locking portion 22 is preferably covered with a material 24 which has a high coefficient of friction so that it will not easily slip when attached to retainer 14. Hanging portion 23 is preferably adjustable in length to allow locking portion 22 to be adjusted to a higher or lower level so as to allow an alignment with retainer 14. This is preferable since the toilet or its seat or cover may vary in dimensions and adjustment of hanging portion 23 allows use of the invention for different toilet seat and cover combinations. One way to accomplish this is shown in FIG. 2 where a threaded portion 25 and a screw portion 26 may be adjusted and a locking nut 27 will lock the length once it has been adjusted to the desired level. Latch 13 is connected to lever 15 by pivot 28 which allows latch 13 to retract and rest against the side of toilet seat cover 11 when toilet seat cover 11 is in a vertical position. Pivot 28 will also allow latch 13 to hang away from toilet seat cover 11 when toilet seat cover 11 is in a horizontal or closed position. Latch 13 is connected to Lever 15 by pivot 28 so as to allow direct rotation of latch 13 when lever 15 is rotated. A gripping tension washer 29 can be used to remove play between lever 15 and toilet seat cover.

Retainer 14 shows a catch portion 31 which has a staggered coil with each end extending as an arm 32 and 33 each of which are bent to have ends 34 and 35 respectively. Retainer 14 is attached to toilet 10 by inserting ends 34 and 35 into the water flush openings in the upper lip of the toilet as can be seen in FIG. 1. The coiled catch portion 31 allows flexibility of ends 34 and 35 and enables it to be adjusted for openings of different distances while also maintaining the function of catch portion 31. Catch portion 31 as seen in FIG. 4 is coiled with the loops spaced apart slightly to allow locking portion 22 of latch 13 to enter from either side. This allows a user to fasten the toilet seat cover 11 down by rotating lever arm 20 in either a clockwise or counterclockwise direction. Preferably retainer 14 is covered with material with a high coefficient of friction and which additionally rinses clean easily. This may be accomplished by many suitable plastics.

In operation, if a user desires to latch the toilet seat cover 11, they merely have to close the cover and turn lever 15, allowing latch 13 to hang away from toilet seat cover 11 with hanging portion 23 adjusted to the right distance allowing locking portion 22 to enter retainer 14 when lever 15 is rotated. A user merely has to rotate the lever in either direction it stops at which point there will be a firm attachment to retainer 14. In order to open toilet seat cover 11, the lever is merely rotated in the opposite direction. The only modification of the toilet seat cover necessary to use a device constructed in accordance with the instant invention is to drill a hole in toilet seat cover 11 which is large enough to allow lever 15 to be inserted through it. After lever 15 has been inserted through it, then latch 13 is affixed to the bottom of lever 15, thus fastening lever 15 in place. Retaining lip 21, which is larger than the hole through the toilet seat cover, on lever 15 supports lever 15 and latch 13 so that they do not fall through the cover 11. Lever 15 must be positioned so that the end 22A of locking portion 22 will rotate so as to contact the far side 31A of catch portion 31 so as to allow locking in either direction as seen in FIG. 3.

One of the features of the instant invention is that retainer 14 will be rinsed clean in each flush cycle by the water which enters the toilet through the flush water inlets in the toilet rim. Another feature is that lever 15 and latch 13 are carried away from the toilet bowl and thus are not soiled during use of the toilet. Finally when one sits on the toilet, since latch 13 is pivotally attached to a lever 15, it lays flush against toilet seat cover 11 and does not protrude enough to cause any discomfort to a user of the toilet.

The device can be made of plastics, or metals such as brass, aluminum, copper or others. Additionally, it may be desired to construct latch 13 and catch portion 31 of magnetically attractive materials to further ensure locking.

Thus it is apparent that there has been provided, in accordance with the invention, an apparatus that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A device for use with a toilet and toilet seat cover comprising:

a lever adapted to fit through a hole in said toilet seat cover so as to allow rotation of said lever when said toilet seat cover is in a horizontal position;

a latch connected to said lever so that said latch will rotate in direct relationship to said lever and pivotally connected to said lever so that when said toilet seat cover is in a vertical position, said latch will lay substantially against said toilet seat cover and when said toilet seat cover is in a horizontal position, said latch will hang away from said toilet seat cover; and, a retainer which is adapted to be affixed to said toilet and postioned so that when said toilet seat cover is in a horizontal position, rotation of said lever will allow rotation of said latch into or out from said retainer.

2. A device as in claim 1 wherein said latch includes a locking portion and a hanging portion wherein said hanging portion allows adjustment to different predetermined lengths.

3. A device as in claim 2 wherein said hanging portion and said locking portion form an angle at their connection of substantially 90° and said locking portion extends toward a catch portion of said retainer so as to contact the far side of said catch portion of said retainer.

4. A device as in claim 2 wherein said locking portion is covered with a material having a high coefficient of friction.

5. A device as in claim 1 wherein said retainer includes an affixing portion allowing attachment of said retainer to a toilet and a catch portion adapted to receive said locking portion of said retainer.

6. A device as in claim 5 wherein said catch portion of said retainer is adapted to receive said locking portion of said latch when said lever is rotated in either a clockwise or counterclockwise direction.

7. A device as in claim 1 wherein said retainer is covered with a material having a high coefficient of friction.

8. A device as in claim 6 wherein said retainer is in the shape of a coil with arms extending from each end of the coil and each arm bent in the same direction.

9. A device as in claim 8 wherein said arms are bent so as to allow insertion into water flush inlet holes of said toilet.

10. A device as in claim 1 wherein said latch and said retainer include magnetically attractive materials.

* * * * *